United States Patent [19]

Edwards

[11] 4,303,157

[45] Dec. 1, 1981

[54] SHIPPING CARTON ASSEMBLY FOR AUTOMOBILE TAILLIGHT ASSEMBLIES

[76] Inventor: Fred S. Edwards, R.D. #3, Hickory Dr., Conneaut Lake, Pa. 16316

[21] Appl. No.: 110,903

[22] Filed: Jan. 10, 1980

[51] Int. Cl.[3] ..... B65D 85/68; B65D 81/02

[52] U.S. Cl. ..... 206/335; 206/448; 206/453; 206/485; 206/590; 206/821; 206/586

[58] Field of Search ..... 206/821, 335, 448, 453, 206/454, 485, 601, 590, 593, 586; 220/23.6

[56] References Cited

U.S. PATENT DOCUMENTS

| | | | |
|---|---|---|---|
| 3,756,429 | 9/1973 | Fleischer | 206/501 |
| 3,804,234 | 4/1974 | Gordon | 206/821 |
| 3,904,030 | 9/1975 | Repp et al. | 206/821 |
| 3,949,876 | 4/1976 | Bridges et al. | 220/23.6 |
| 4,033,455 | 7/1977 | Robison | 206/485 |
| 4,098,400 | 7/1978 | Brown . | |

*Primary Examiner*—Joseph Man-Fu Moy

[57] ABSTRACT

A shipping carton assembly for automobile taillight assemblies. The assemblies are enclosed in cartons and two cartons are stacked on a pallet. There are two tiers of assemblies in each carton and each tier may support, for example, eight taillight assemblies. The assemblies are arranged parallel to each other with each of the ends of the assemblies resting on two parallel laterally-spaced boards; two second boards rest on top of the ends of the assemblies and the ends of the second tier of taillight assemblies rest on the second boards. Two third boards rest on the top of the ends of the second tier of taillight assemblies and the entire arrangement of the first tier and second tier are disposed in the carton. The lower intermediate boards and upper intermediate boards are slotted to receive flanges on the ends of the taillight assemblies and lugs on the taillight assemblies are received in the openings in the upper board and in the lower board so that the taillight assemblies are held in rigid spaced relation to each other.

14 Claims, 10 Drawing Figures

FIG. 6
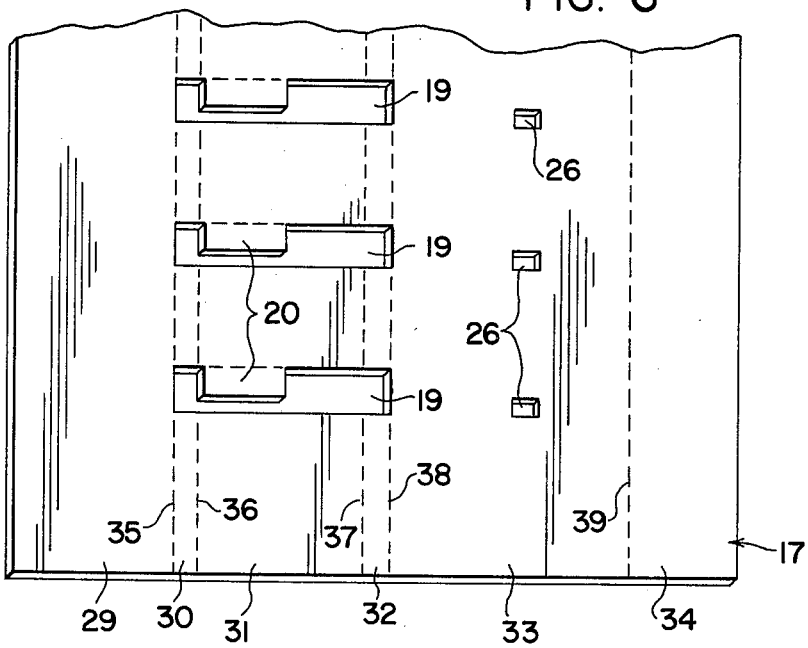
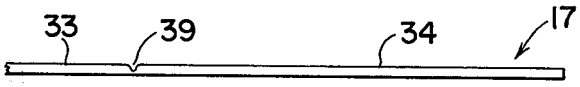
FIG. 6A
FIG. 7
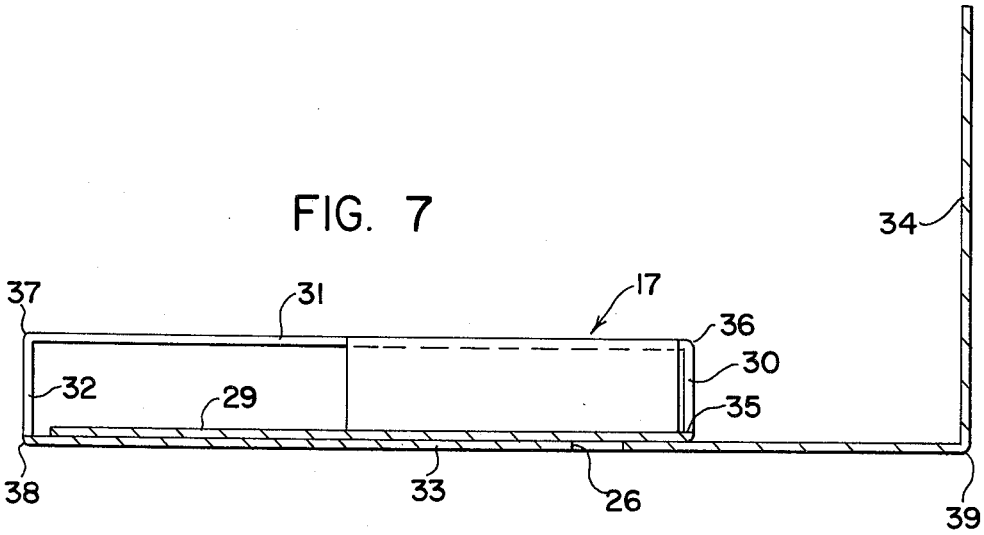

SHIPPING CARTON ASSEMBLY FOR AUTOMOBILE TAILLIGHT ASSEMBLIES

GENERAL DESCRIPTION OF THE INVENTION

Taillight assemblies for automobiles are molded of thin light weight material. They are generally concave on one side and convex on the other so that they present a problem in packaging them for shipment.

Applicant has discovered that by supporting the taillight assemblies on their edge with the convex side of each assembly facing the concave side of the one adjacent it and supporting them in two tiers, one above the other, a maximum number of the assemblies can be supported in a minimum space.

OBJECTS OF THE INVENTION

It is accordingly an object of the invention to provide an improved taillight assembly packaging arrangement.

Another object of the invention is to provide a packaging arrangement for taillight assemblies that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 6 is a partial view of one of the upper intermediate spacers.

FIG. 6A is a partial end view of FIG. 6.

FIG. 7 is a longitudinal cross-sectional view of one of the intermediate spacers.

DETAILED DESCRIPTION OF THE DRAWINGS

Figure 1:
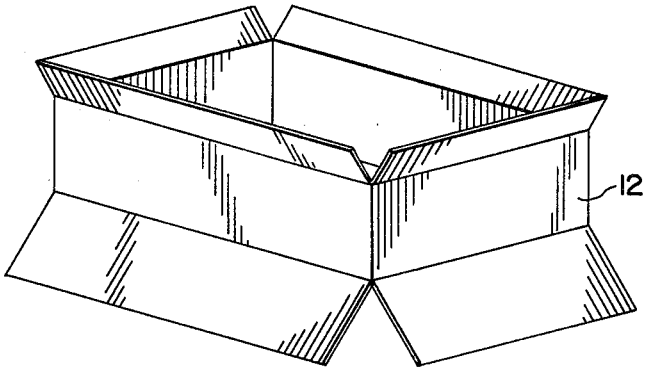
FIG. 1 is an isometric view of the carton for containing the two tiers of taillight assemblies.
Figure 3:
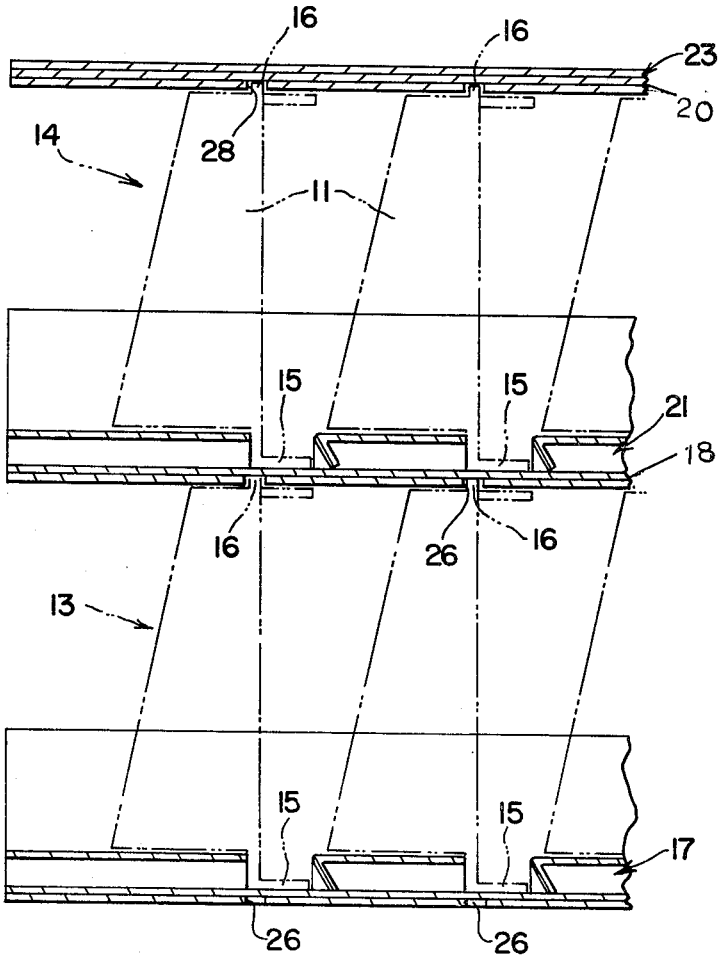
FIG. 3 is a longitudinal cross-sectional view taken on Line 3—3 of FIG. 4.
Figure 2:
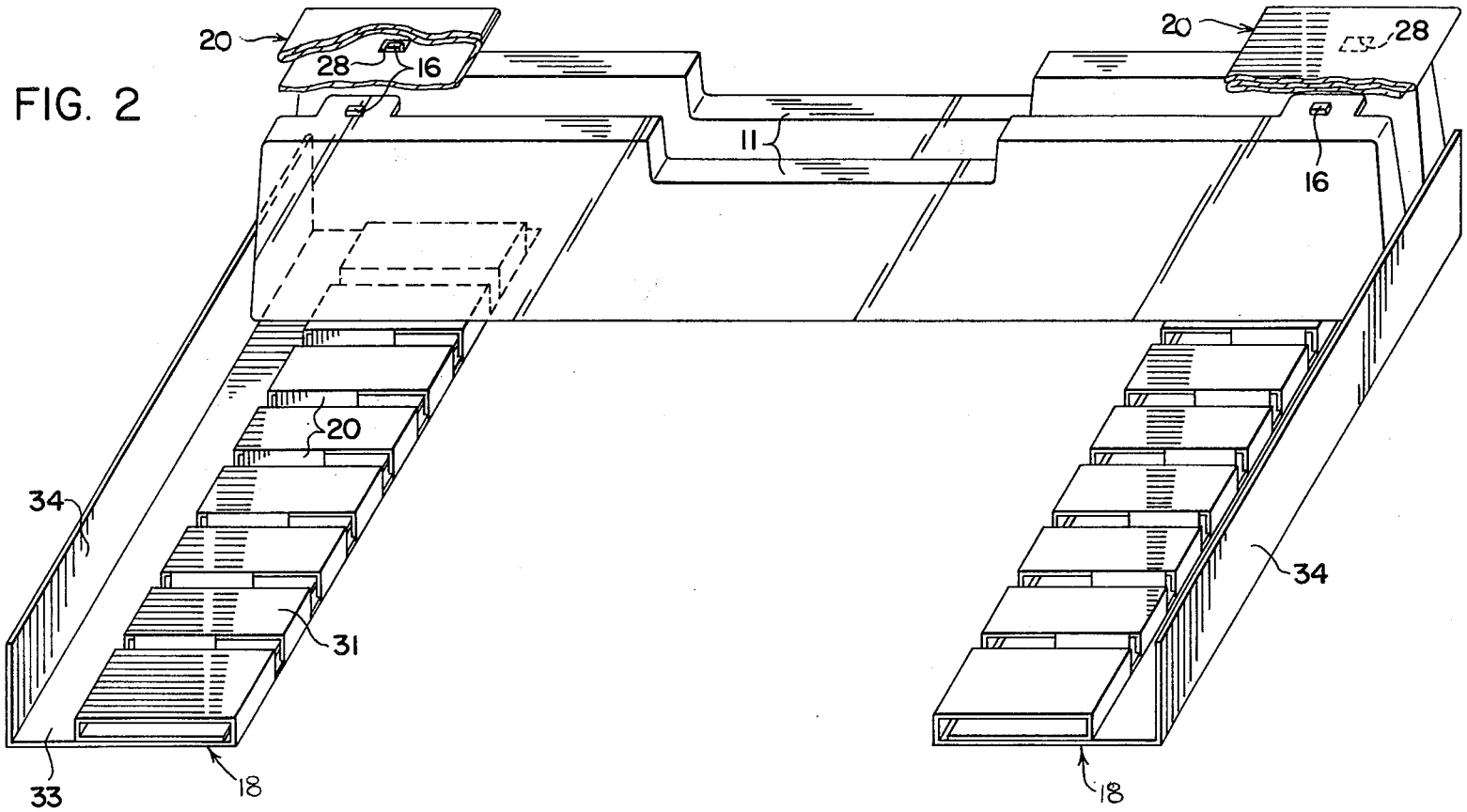
FIG. 2 is an isometric view partly in cross-section showing two taillight assemblies of the upper tiers supported on the laterally extending spacers.
Figure 4:
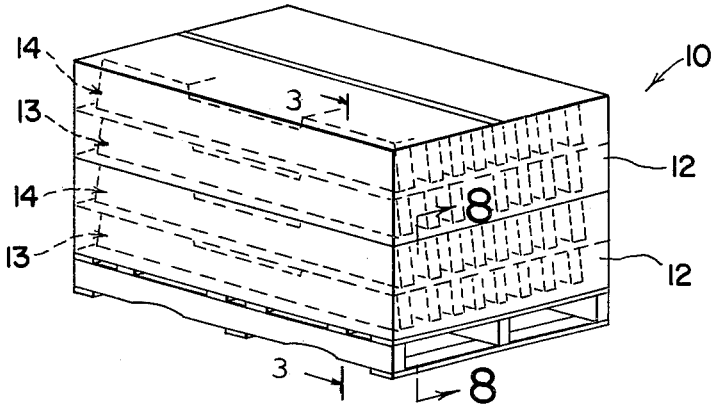
FIG. 4 is an isometric view showing two cartons of taillight assemblies stacked on a pallet.

Now, with more particular reference to the drawings. A package 10 for automobile taillight assemblies 11 is disclosed made up of a carton 12 adapted to contain two tiers 13 and 14 of said assemblies 11. Each of the tiers 13 and 14 comprise a plurality of the assemblies 11 arranged in parallel relation to each other. The taillight assemblies are concave on one side and convex on the others so they nest in each other and they are supported on edge to occupy the minimum amount of space.

Each of the assemblies 11 is nested in the assembly 11 adjacent it. Each assembly 11 has a laterally extending flange 15 on each end, this flange is received in the slots in the intermediate spacer members as will be later herein described.

The first rectangular elongated board 17 is supported on the bottom of the carton 12. A second elongated rectangular board 18 is identical to board 17 and it is disposed above the lower tier of taillight assemblies elongated rectangular board 17. The lower tier 13 of the taillight assemblies sandwiched between the boards 17 and 18, which are identical to upper tier of taillight assemblies, is sandwiched between the boards 18 and 20. The ends of the upper tier of the taillight assemblies 11 are sandwiched between the boards 18 and 20. The ends of the boards 17 and 18 have flaps 34 that extend up along the ends of the taillight assemblies 11 to protect their ends.

The boards 17 and 18 and boards which are identical to them are shown in detail in FIGS. 6 and 7 and have slots 19 formed in them, which receive the flanges 15 on the lower edge of the taillight assemblies and the boards 20 have holes 28 and boards 17 and 18 have holes 26 that receive the lugs 16; thus, the slots 19 and the holes 28 hold the taillight assemblies in rigid spaced relation relative to each other for shipment. The flaps 34 protect the ends of the taillight assemblies from damage from chafing against the inside of the carton.

Boards 17 and 18 each have a first part 29 and a second part 30, a third part 31 and a fourth part 32, a fifth part 33 and a sixth part 34. The parts are folded so that the first part 29 is disposed between the fifth part 33 and the third part 31. The second part 30 and the third part 31 and the fourth part 32 have the slots 31 therein.

As shown in FIG. 7, the first part 29 and fifth part 33 of boards 17 and 18 are disposed in parallel planes. The second part 30 and the fourth part 32 are perpendicular to the first part 29 and the third part 31 and the fifth part 33. The first scored line 35, the second scored line 36 and the third scored line 37 and the fourth scored line 38 and the fifth scored line 39 are formed in the roll-up assemblies to assist in folding. The first scored line 35 is disposed between the first part 29 and the second part 30, the second scored line 36 is disposed between the second part 30 and the third part 31, the third scored line 37 between the third part 31 and the fourth part 32 and the fourth scored line 38 between the fourth part 32 and the fifth part 33, the fifth scored line 39 is between the fifth part 33 and the sixth part 34. Scoring cardboard is a technique familiar to those skilled in the art.

The scored lines make it easier to fold the boards. The boards making up the die cut roll-up dividers 17 and 18 may be made of heavy corrugated cardboard or the like.

Figure 5:
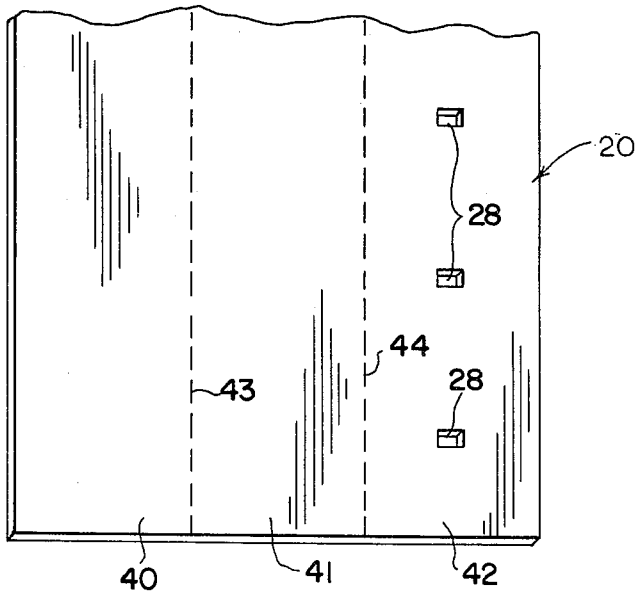
FIG. 5 is a partial plan view of one of the outside spacers.
Figure 5A:
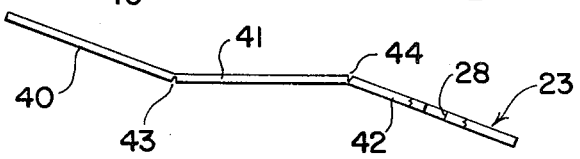
FIG. 5A is a partial end view of FIG. 5.
Figure 8:
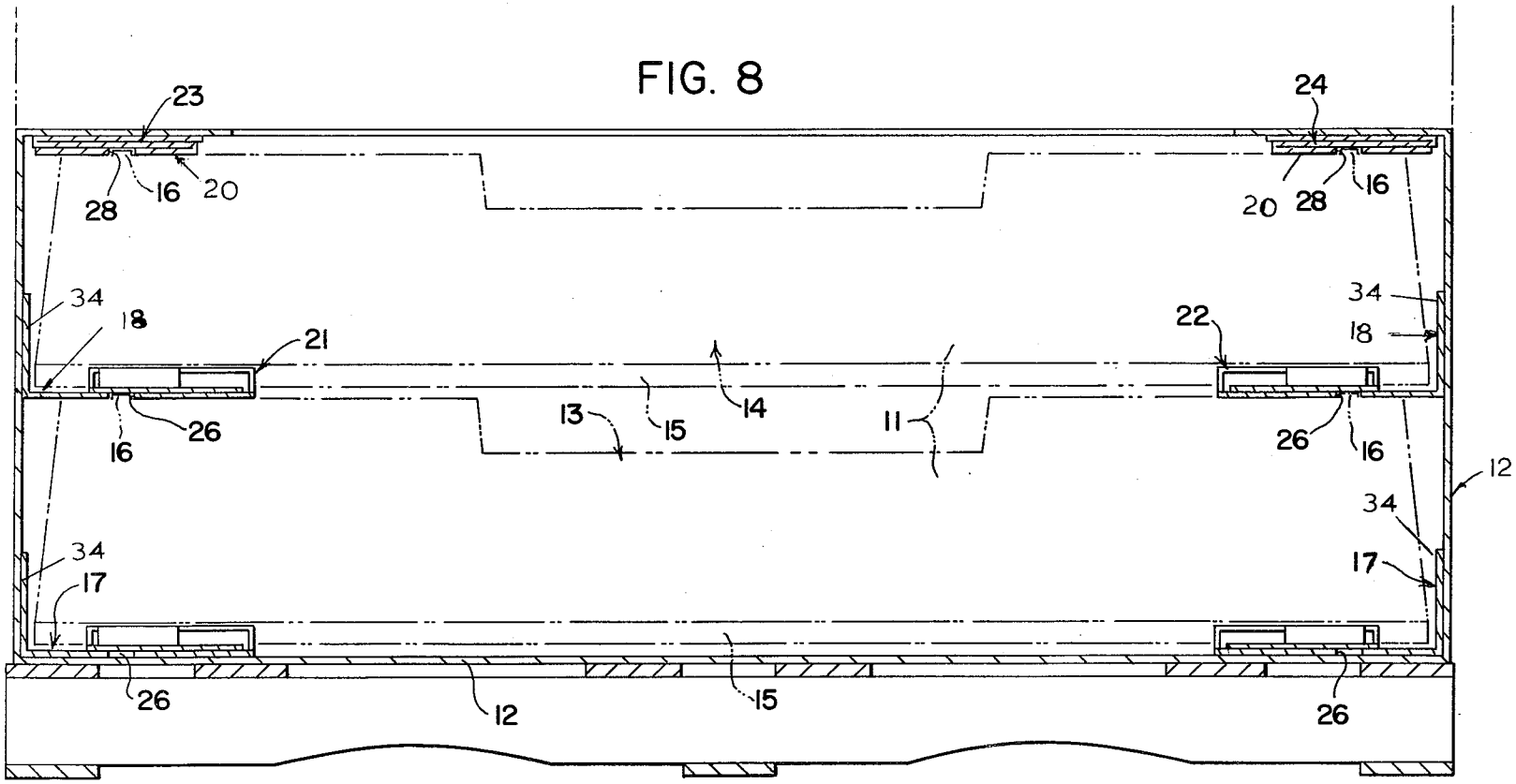
FIG. 8 is a cross-sectional view taken on Line 8—8 of FIG. 4.

The boards 20 are in the form of die cut roll-up assemblies made from a flat sheet as shown in FIGS. 5 and 5A. They may be made from corrugated cardboard cut part way through along line 43 from a first side defining first part 40, second part 41 and third part 42. Since the cuts are made from one side only, the pieces 40 and 41 remain hinged together and pieces 41 and 42 remain hinged together by their uncut sides.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A package for automobile taillight assemblies comprising, a carton adapted to contain two tiers of said assemblies, a first tier and a second tier of said assemblies comprising a plurality of assemblies disposed in parallel relation to each other, each said assembly being nested within the assembly adjacent to it, a first elongated rectangular board, disposed at one side of said carton, and supported on the bottom thereof, a second rectangular board (adapted to be) supported on the bottom of said carton, at a side opposite said first rectangular board and spaced from said first rectangular board and disposed generally parallel to said first rectangular board, the ends of said first tier of assemblies resting on said rectangular boards, a third rectangular board and a fourth rectangular board resting on the ends of said first tier of assemblies on the side thereof opposite said first rectangular boards and second rectangular boards and means on the ends of said taillight assemblies engaging recesses in each of said rectangular boards, said rectangular boards holding said taillight assemblies in spaced relation to each other.

2. A package for automobile taillight assemblies comprising, a carton adapted to contain two tiers of said assemblies, a first tier and a second tier of said assemblies comprising a plurality of assemblies disposed in parallel relation to each other, each said assembly being nested within the assembly adjacent to it, a first elongated rectangular board, a second rectangular board adapted to be supported on the bottom of said carton, the ends of said first tier of assemblies resting on said rectangular boards, a third rectangular board and a fourth rectangular board resting on the ends of said first tier of assemblies on the side thereof opposite said first rectangular boards and second rectangular boards and means on the ends of said taillight assemblies engaging recesses in each rectangular boards holding said taillight assemblies in spaced relation to each other, said first and second rectangular boards each have a flap thereon extending over a part of an end of said taillight assemblies between said taillight assemblies and the ends of said carton.

3. The package recited in claim 2 wherein a fifth rectangular board and a sixth rectangular board rests on said third rectangular board and said fourth rectangular board and a plurality of taillight assemblies comprising a second tier resting on said third rectangular board and said fourth rectangular board.

4. The package recited in claim 3 wherein said third rectangular board has flaps thereon extending along the ends of said second mentioned tier of taillight assemblies holding said second mentioned taillight assemblies in spaced relation to an end of said carton.

5. The package recited in claim 3 or claim 4 wherein said third boards comprise die cut roll-up spacers.

6. The package recited in claim 5 wherein said means on said first and second rectangular boards for engaging said taillight assemblies comprise longitudinally spaced slots in said rectangular boards and each said taillight assembly has a flange on its end on one side thereof received in a said slot.

7. The package recited in claim 5 wherein said means on said third rectangular boards engaging said taillight assembly comprises a lug on each of said taillight assembly received in a notch in said second and third rectangular boards.

8. The package recited in claim 7 wherein each said rectangular board comprises a die cut roll-up divider.

9. The package recited in claim 8 wherein said first and second rectangular boards comprise score pad scored along its length whereby said score pad can be bent in L-shape, one leg of said L has said holes therein for receiving said lugs on said taillight assembly, the other said leg of said L extending upward and along the end of said taillight assemblies providing said flap for said protection for the ends of said taillight assemblies.

10. The package recited in claim 9 wherein said first and second rectangular boards each comprise a die cut roll-up divider having a first part, a second part, a third part, a fourth part, a fifth part and a sixth part, said first parts being disposed between said third parts and said fifth parts, said second parts, said third parts and said fourth parts having said slots therein, said fourth part being disposed between said fifth part and said third part.

11. The package recited in claim 10 wherein said first parts and said fifth part of said boards are disposed in parallel planes, said second part and said fourth part are disposed generally perpendicular to said first part and said third part and said fifth part.

12. The package recited in claim 11 wherein a first scored line, a second scored line and a third scored line and a fourth scored line and a fifth scored line are formed in said die cut roll-up assembly, said first scored line being disposed between said first part and said second part, said second scored line being disposed between said second part and said third part, said third scored line being disposed between said third part and said fourth part, said fourth scored line being disposed between said fourth part and said fifth part, said fifth scored line being disposed between said fifth part and said sixth part.

13. The package recited in claim 12 wherein said flanges on said taillight assemblies are received in said slots with said fourth part extending upwardly generally perpendicular to said fifth part providing partition along the end of said taillight assembly.

14. The package recited in claim 13 wherein each said die cut roll-up divider (12) having a first part (29), a second part (30), a third part (31), a fourth part (32), a fifth part (33) and a sixth part (34), said first parts being disposed between said third part and said fifth part, said second part (30), said third part (31) and said fourth part (32) having said slots therein, said fourth part (32) being disposed between said fifth part (33) and said third part (31), said first part and said fifth part being disposed in parallel planes, said second part (30) and said fourth part (32) being disposed generally perpendicular to said first part (29), said third part (31) and said fifth part (33), a first scored line (35), a second scored line (36) and a third scored line (37), and a fourth scored line (38) and a fifth scored line (39), said first scored line being disposed between said first part and said second part, said second scored line being disposed between said second part and said third part, said third scored line being disposed between said third part and said fourth part, said fourth scored line being disposed between said fourth part and said fifth part, said fifth scored line being disposed between said fifth part and said sixth part, said flanges on said taillight assemblies being received in said slots with said fourth part extending upwardly generally perpendicular to said fifth part providing a partition along the end of said taillight assemblies, there being eight said slots on each said die cut roll-up divider receiving flanges of eight said taillight assemblies, whereby sixteen said taillight assemblies received in each said container.

* * * * *